US012171343B2

(12) United States Patent
Hotard

(10) Patent No.: US 12,171,343 B2
(45) Date of Patent: Dec. 24, 2024

(54) SYSTEMS, METHODS, AND APPARATUSES FOR A CONVERTIBLE CHILDREN'S SEAT

(71) Applicant: GRACO CHILDREN'S PRODUCTS, INC., Atlanta, GA (US)

(72) Inventor: David Hotard, Peachtree Corners, GA (US)

(73) Assignee: GRACO CHILDREN'S PRODUCTS INC., Atlanta, GA (US)

( * ) Notice: Subject to any disclaimer, the term of this patent is extended or adjusted under 35 U.S.C. 154(b) by 239 days.

(21) Appl. No.: 17/820,030

(22) Filed: Aug. 16, 2022

(65) Prior Publication Data

US 2023/0058918 A1 Feb. 23, 2023

Related U.S. Application Data

(60) Provisional application No. 63/234,077, filed on Aug. 17, 2021.

(51) Int. Cl.

*A47D 11/00* (2006.01)
*A47D 13/06* (2006.01)
*A47D 13/08* (2006.01)

(52) U.S. Cl.

CPC ..... *A47D 11/007* (2013.01); *A47D 11/002* (2013.01); *A47D 13/06* (2013.01); *A47D 13/08* (2013.01)

(58) Field of Classification Search

CPC .... A47D 11/007; A47D 11/002; A47D 11/00; A47D 1/02; A47D 15/008; A47D 13/08; A47C 16/005

See application file for complete search history.

(56) References Cited

U.S. PATENT DOCUMENTS 2,285,900 A * 6/1942 Chapman ..... A47K 3/127 297/229
2,384,234 A * 9/1945 Breese ..... A47B 85/04 297/423.39

(Continued)

FOREIGN PATENT DOCUMENTS

CN 201958342 U * 9/2011 ..... A47D 11/002
CN 104490168 A * 4/2015 ..... A47D 1/004

(Continued)

OTHER PUBLICATIONS

Fisher-Price, "Sit-Me-Up Floor Seat" https://shop.mattel.com/products/sit-me-up-floor-seat-gvg57; 12 pages.

(Continued)

*Primary Examiner* — Timothy J Brindley
(74) *Attorney, Agent, or Firm* — Eversheds Sutherland (US) LLP

(57) ABSTRACT

A convertible children's seat may include a chair component, and enclosure component, and soft goods. The chair component may include a base, a stationary plate mounted to the base, and a seat back mounted to and rotatable about the stationary plate. The soft goods may be wrapped around the chair component and the enclosure component. The seat back may be configured to rotate between an open configuration and a closed configuration. The chair component is configured to be removably mounted to the enclosure component. A children's seat apparatus may include a chair component and an enclosure component. A method for implementing a convertible children's seat may include providing the convertible children's seat and causing the convertible children's seat to be moved between an open configuration and a closed configuration when the seat back is rotated about the stationary plate.

18 Claims, 10 Drawing Sheets

(56) References Cited

U.S. PATENT DOCUMENTS

| | | | | | |
|---|---|---|---|---|---|
| 3,995,331 | A * | 12/1976 | Fotre | A47K 3/064 | 4/572.1 |
| 5,160,185 | A * | 11/1992 | Stang | A61F 5/3792 | 5/655 |
| 9,370,257 | B2 * | 6/2016 | Roberts | A47D 13/08 | |
| 10,702,104 | B2 * | 7/2020 | Ramirez | A47K 3/03 | |
| 2002/0092094 | A1 * | 7/2002 | Welsh, Jr. | A47D 13/063 | 5/95 |
| 2005/0028286 | A1 * | 2/2005 | Smart | A61F 5/3784 | 5/655 |
| 2010/0229301 | A1 * | 9/2010 | Arnold, IV | A47D 11/007 | 5/93.2 |
| 2015/0182028 | A1 * | 7/2015 | Thein | A47D 1/10 | 297/230.12 |
| 2015/0313377 | A1 * | 11/2015 | Davis | A47K 3/12 | 5/655 |
| 2015/0320233 | A1 * | 11/2015 | Cooper | A47D 1/00 | 297/353 |
| 2017/0258244 | A1 * | 9/2017 | Waldman | A47D 1/10 | |
| 2019/0254443 | A1 * | 8/2019 | Longenecker | A47D 9/012 | |
| 2019/0298080 | A1 * | 10/2019 | Coleman | A47D 1/02 | |
| 2023/0112093 | A1 * | 4/2023 | Tyneski | A47D 1/02 | 297/19 |
| 2024/0099482 | A1 * | 3/2024 | Rumfola, III | A47D 1/008 | |

FOREIGN PATENT DOCUMENTS

| | | | | |
|---|---|---|---|---|
| CN | 108784136 | A * | 11/2018 | A47D 13/00 |
| CN | 110169678 | A * | 8/2019 | A47D 11/00 |
| CN | 111839094 | A * | 10/2020 | |
| GB | 2387338 | A * | 10/2003 | A47D 1/02 |
| GB | 2484933 | A * | 5/2012 | A47C 16/005 |
| WO | WO-2015159401 | A1 * | 10/2015 | A47D 1/002 |

OTHER PUBLICATIONS

Summer, "Learn-To-Sit™ Floor Seat" https://summerinfant.co.uk/product/learn-to-sit-floor-seat/; 6 pages.

Graco, "Pack 'n Play Rock 'n Grow Playard" https://www.gracobaby.com/home-and-gear/pack-n-play-playards/newborn-seat-changer/pack-n-play-rock-n-grow-playard/SAP_2121215.html; 8 pages.

* cited by examiner

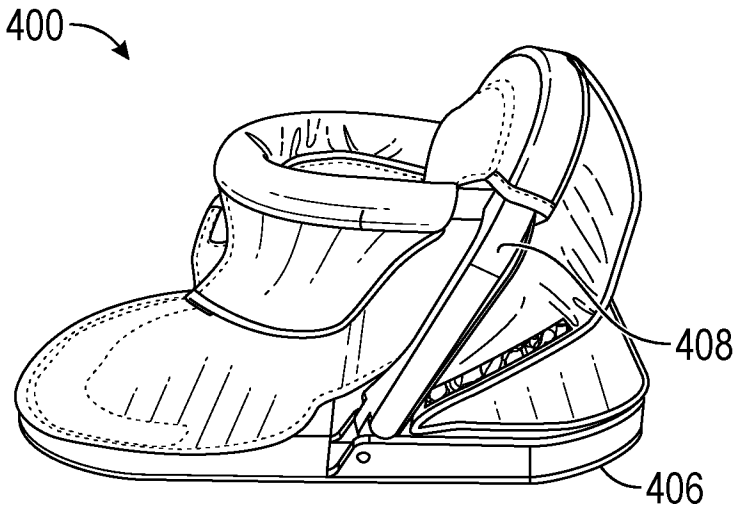
FIG. 4
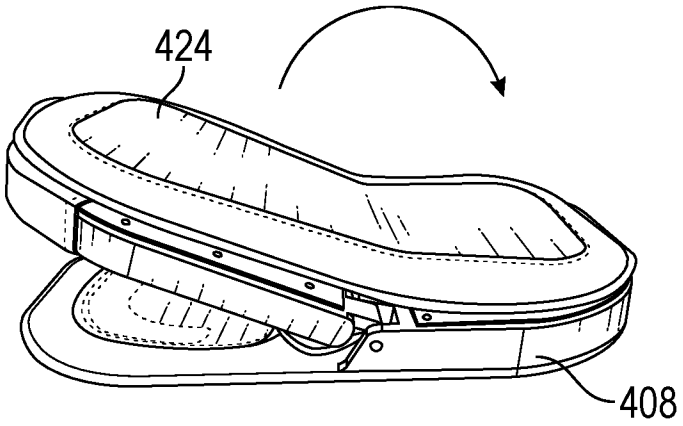

SYSTEMS, METHODS, AND APPARATUSES FOR A CONVERTIBLE CHILDREN'S SEAT

CROSS-REFERENCE TO RELATED APPLICATIONS

The present applications claims the benefit of U.S. Provisional Application No. 63/234,077, filed on Aug. 17, 2021, which is herein incorporated by reference in its entirety.

TECHNICAL FIELD

The present disclosure is generally directed to children's products, and more particularly to systems, methods, and apparatuses for a convertible children's seat.

BACKGROUND

Conventional children's seats are well-known in the art. Typically, a children's seat can include a chair component, such that the child can be disposed within the chair component, and an enclosure component that surrounds the chair component. Some children's seats, and more specifically, children's floor seats, may be configured for being disposed on a ground surface.

In many conventional children's floor seats, it may be desired for a children's floor seat to be configured to be disposed on an elevated surface in addition to floor surfaces. It may also be desired for a parent or other user to transport a child while the child is disposed within the children's floor seat. It may additionally be desired for a children's floor seat to further function as a bassinet. However, in many conventional children's floor seats, the children's floor seat may not be configured for such capabilities. Further, conventional solutions that attempt to provide such capabilities include clip-on chairs that can be mounted to a table or a counter, and loungers that can be mounted to a playard.

However, these solutions that are employed in conventional children's floor seats are not preferred for a variety of reasons. For example, the clip-on chairs may not be compatible with all tables and counters because tables and counters may vary in shape and size. Further, the loungers that are not also playard accessories may not be configured for transportation when a child is disposed within the lounger.

SUMMARY

The present disclosure is generally directed to children's products, and more particularly to systems, methods, and apparatuses for a convertible children's seat.

In embodiments, the present disclosure describes a convertible children's seat. The convertible children's seat may include a chair component, and enclosure component, and soft goods. The chair component may include a base, a stationary plate mounted to the base, and a seat back mounted to the stationary plate. The seat back may be rotatable about the stationary plate. The enclosure component may include a first leg comprising a first vertical stand and a first end, a second leg comprising a second vertical stand and a second end, and a wraparound bar mounted to an upper portion of the first leg and an upper portion of the second leg. The soft goods may be wrapped around the chair component and the enclosure component. The seat back may be configured to rotate between an open configuration and a closed configuration. The chair component is configured to be removably mounted to the enclosure component.

In embodiments, the present disclosure describes a children's seat apparatus. The apparatus may include a chair component and an enclosure component. The chair component may include a base, a stationary plate mounted to the base, and a seat back rotatably mounted to the stationary plate. The seat back may be configured to rotate between an open configuration and a closed configuration. The chair component is configured to be removably mounted to the enclosure component.

In embodiments, the present disclosure describes a method for implementing a convertible children's seat. The method may include providing a convertible children's seat. The convertible children's seat may include an enclosure component, and a chair component configured to be removably mounted to the enclosure component. The chair component may include a base, a stationary plate mounted to the base, and a seat back rotatably mounted to the stationary plate. The method may further include causing the convertible children's seat to be moved between an open configuration and a closed configuration when the seat back is rotated about the stationary plate.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout the present disclosure, depending on the context, singular and plural terminology may be used interchangeably.

FIG. 4 is a side view of an example convertible children's seat in accordance with one example embodiment of the present disclosure.

Figure 1A:
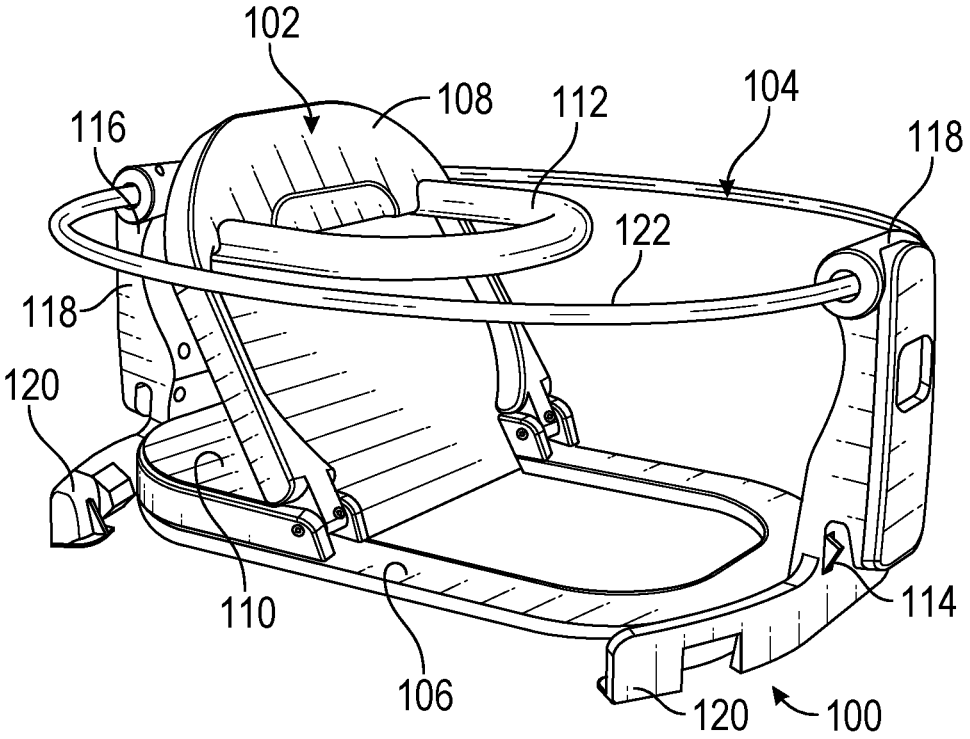
FIG. 1A is a perspective view of an example convertible children's seat in accordance with one example embodiment of the present disclosure.

The present disclosure will now provide a more detailed and specific description that will refer to the accompanying drawings. The drawings and specific descriptions of the drawings, as well as any specific or other embodiments discussed, are intended to be read in conjunction with the entirety of the present disclosure.

DETAILED DESCRIPTION

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that the present disclosure will be thorough and complete, and will fully convey the scope of the concepts to those skilled in the art. Like numbers refer to like, but not necessarily the same or identical elements throughout.

Certain relationships between features of the children's products, such a convertible children's seat, for example, are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variation that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

The present disclosure relates to, among other things, systems, apparatuses, and methods for a convertible children's seat. In one embodiment, a system, method, and apparatus for a convertible children's seat can be provided. Embodiments of the present disclosure can provide a technical solution to the problem of configuring a children's seat to be disposed on other surfaces in addition to a floor surface and configuring a children's seat to be transportable even when the child is disposed within the children's seat.

In one example embodiment, a system and apparatus for a convertible children's seat can be provided. The children's product accessory can include a chair component and an enclosure component.

In embodiments, the chair component may include a base, a stationary plate mounted to the base, and a seat back rotatably mounted to the stationary plate.

In embodiments, the chair component may include a chest bar rotatably attached to an underside of the seat back. In some such embodiments, the chest bar is U-shaped.

In embodiments, the enclosure component may include a first leg and a second leg. In some such embodiments, each of the first leg and the second leg may include a vertical stand and an end.

In embodiments, the chair component may be mounted to each of the ends.

In embodiments, the enclosure component may further include a wraparound bar mounted to an upper portion of each of the first leg and the second leg.

In embodiments, the enclosure component may be configured to form a portion of a hard goods structure of a children's product. In some such embodiments, the children's product may be a bassinet.

In embodiments, the convertible children's seat may be configured to rotate between a closed configuration and an open configuration. In some such embodiments, when the convertible children's seat is in a closed configuration, the seat back is rotated until it is disposed on the base. In embodiments, when the convertible children's seat is in an open configuration, the seat back is rotated about the stationary plate and the chest bar is rotated outwards from the seat back.

In embodiments, a method for a convertible children's seat may be provided.

Turning to the figures, FIG. 1A depicts a perspective view of an example convertible children's seat 100 according to an embodiment of the present disclosure. The convertible children's seat 100 may include a chair component 102 and an enclosure component 104. In some embodiments, the chair component 102 may be removably mounted to the enclosure component 104.

As depicted in FIG. 1A, the chair component 102 may include a base 106. The base 106 may be substantially ring-shaped. In some embodiments, the base 106 may be made of a rigid or a substantially rigid material. In some embodiments, the base 106 may be further shaped in a substantially oval or rectangular shape. In some embodiments, the base 106 may have rounded edges. The chair component 102 may further include a seat back 108 rotatably mounted to a stationary plate 110. In some embodiments, the stationary plate 110 may be substantially semi-circular, substantially oval-shaped, or any other appropriate shape for covering a portion of the base 106. The stationary plate 110 may be mounted to the base 106 such that the stationary plate 110 cannot be rotated about the base 106.

Figure 1B:
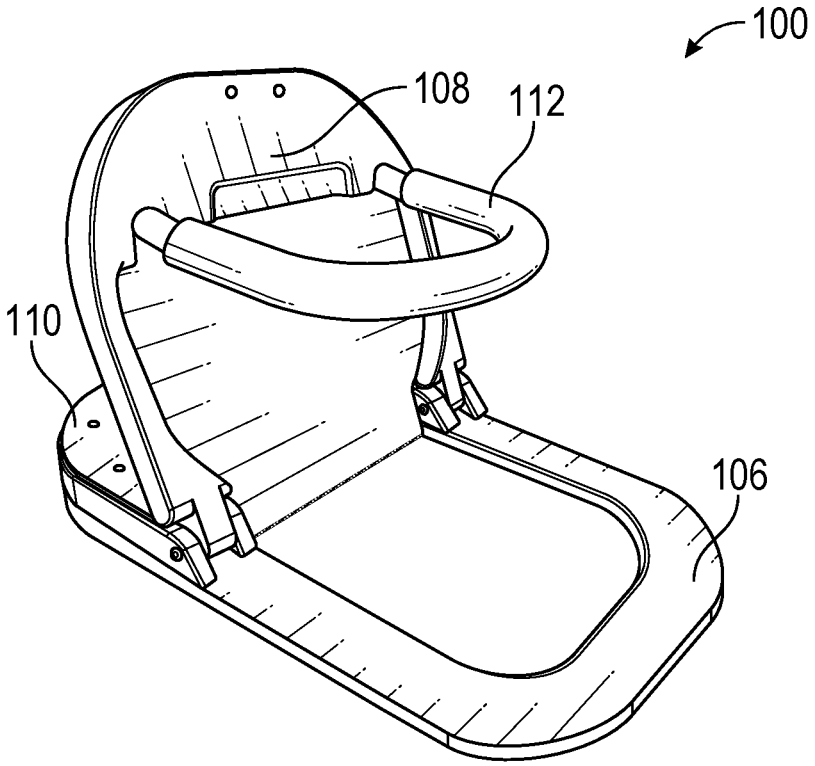
FIGS. 1B-1C are perspective views of an example chair component of the convertible children's seat depicted in FIG. 1A in accordance with one example embodiment of the present disclosure.
Figure 1C:
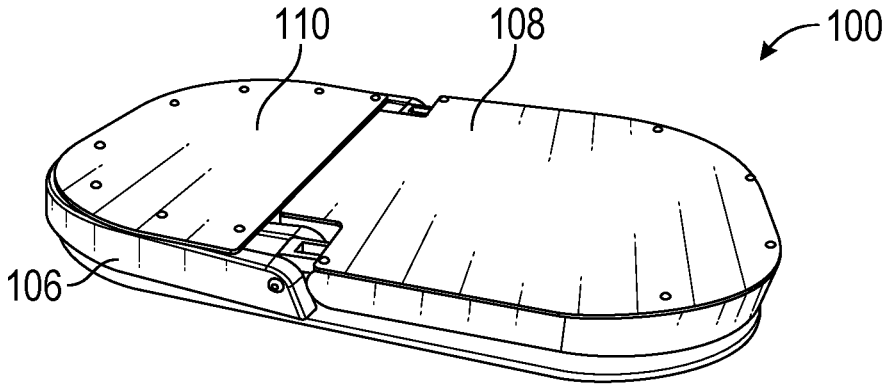

As further depicted in FIG. 1A, the chair component may further include the seat back 108. The seat back 108 may be substantially semi-circular, substantially oval-shaped, or any other appropriate shape such that a combination of the seat back 108 and the stationary plate 110 may completely or substantially cover the base 106 when the convertible children's seat 100 is in a closed configuration, as depicted in FIG. 1C. In some embodiments, as depicted in FIGS. 1A and 1B, the convertible children's seat 100 may be rotated into an open configuration by rotating the seat back 108 in an upwards direction away from the base 106 and relative to the stationary plate 110. The seat back 108 may be rotatably mounted to the stationary plate 110 by any conventional rotatable joint that is well-known in the art.

In some embodiments, the seat back 108 may be configured to have a maximum rotation of between about 90 degrees and about 180 degrees. Thus, the seat back 108 may be configured to maximally rotate such that the seat back 108 may be upright or may be angled towards the stationary plate 110.

In some embodiments, the seat back 108 may further include a chest bar 112 extending from an underside of the seat back 108. In some embodiments, the chest bar 112 may be U-shaped. In some embodiments, upper portions of the chest bar 112 may be mounted to an underside of the seat back 108. Although not depicted in FIGS. 1A-1C, the upper portions of the chest bar 112 may be rotatably mounted to the underside of the seat back 108 by any conventional rotatable joint that is well-known in the art. Thus, when the convertible children's seat 100 is in a closed configuration, the chest bar 112 may be configured to be rotated towards the underside of the seat back 108. In some embodiments, portions of the underside of the seat back 108 may be hollowed out in order for the chest bar 112 to be rotated inwards and disposed on an underside of a surface of the seat back 108. Further, when the convertible children's seat 100 is in an open configuration, the chest bar 112 may be rotated outwards and away from the seat back 108 after the seat back 108 has been rotated into an open configuration.

In some embodiments, the enclosure component 104 may include a first leg 114 and a second leg 116. Each of the first leg 114 and the second leg 116 may include a vertical stand 118 and an end 120. Each of the ends 120 may be configured to be removably attached to the base 106. In some embodiments, the enclosure component may further include a wraparound bar 122 that is mounted to an upper portion of the first leg 114 and the second leg 116. In some embodiments, the wraparound bar 122 may be elevated above the base 106, and the wraparound bar 122 may be of a relatively larger size than the base 106. In some embodiments, the shape formed by the wraparound bar 122 may be substantially similar to the shape of the base 106.

In some embodiments, the enclosure component 104 may form a portion of the hard goods structure of another children's product, such as a bassinet.

Figure 2:
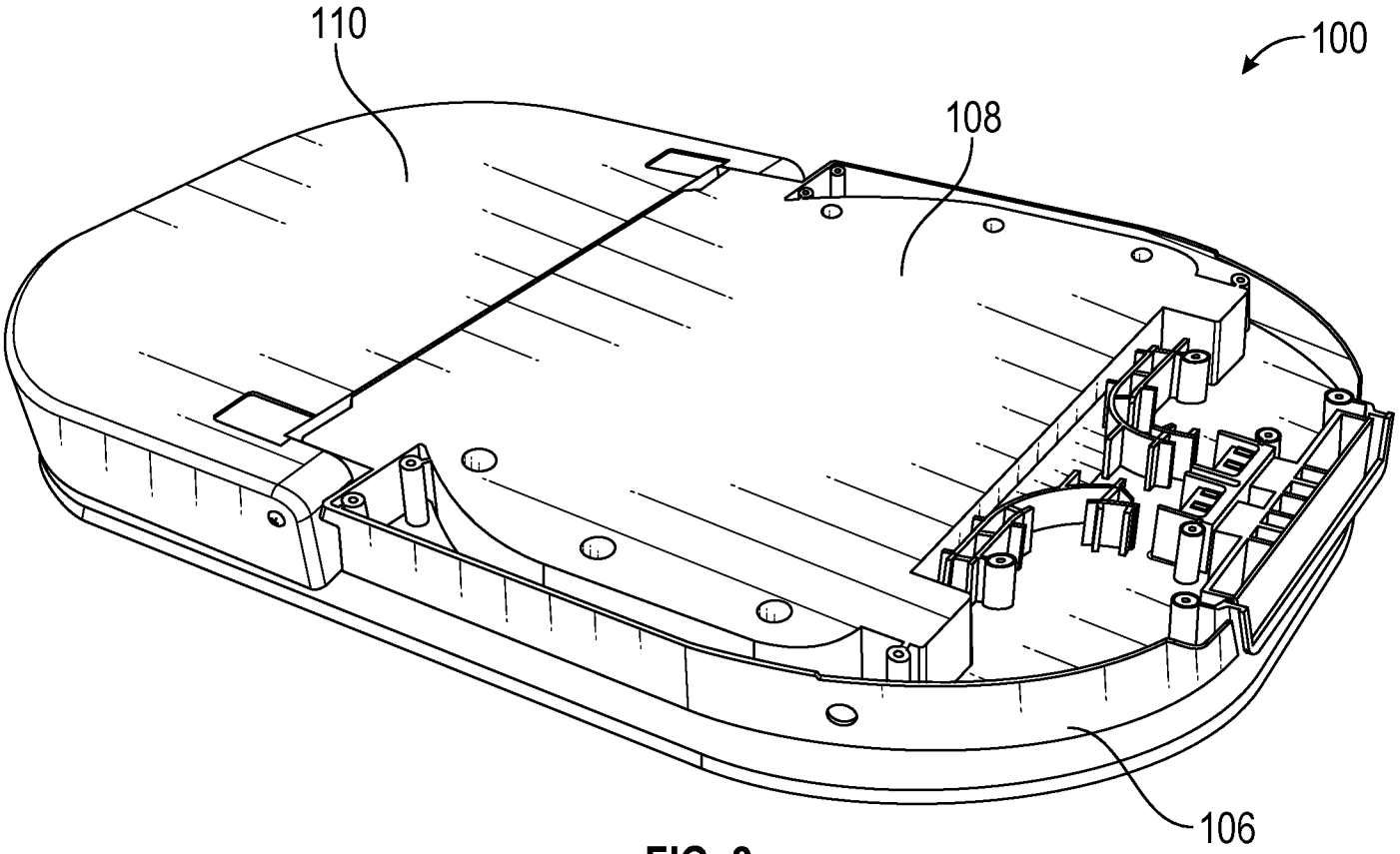
FIG. 2 is a perspective view of an example chair component of a convertible children's seat in a closed configuration in accordance with one example embodiment of the present disclosure.

FIG. 2 depicts a perspective view of the chair component 102 of the convertible children's seat 100 depicted in FIG. 1 in a closed configuration. As depicted in FIG. 2, the stationary plate 110 is mounted to the base 106. In the closed configuration, as depicted in FIG. 2, the seat back 108 is disposed on the base 106 and is not rotated upwards towards the stationary plate 110, and the chest bar 112 is tucked under the seat back 108 (and is therefore not visible in FIG. 2).

Figure 3:
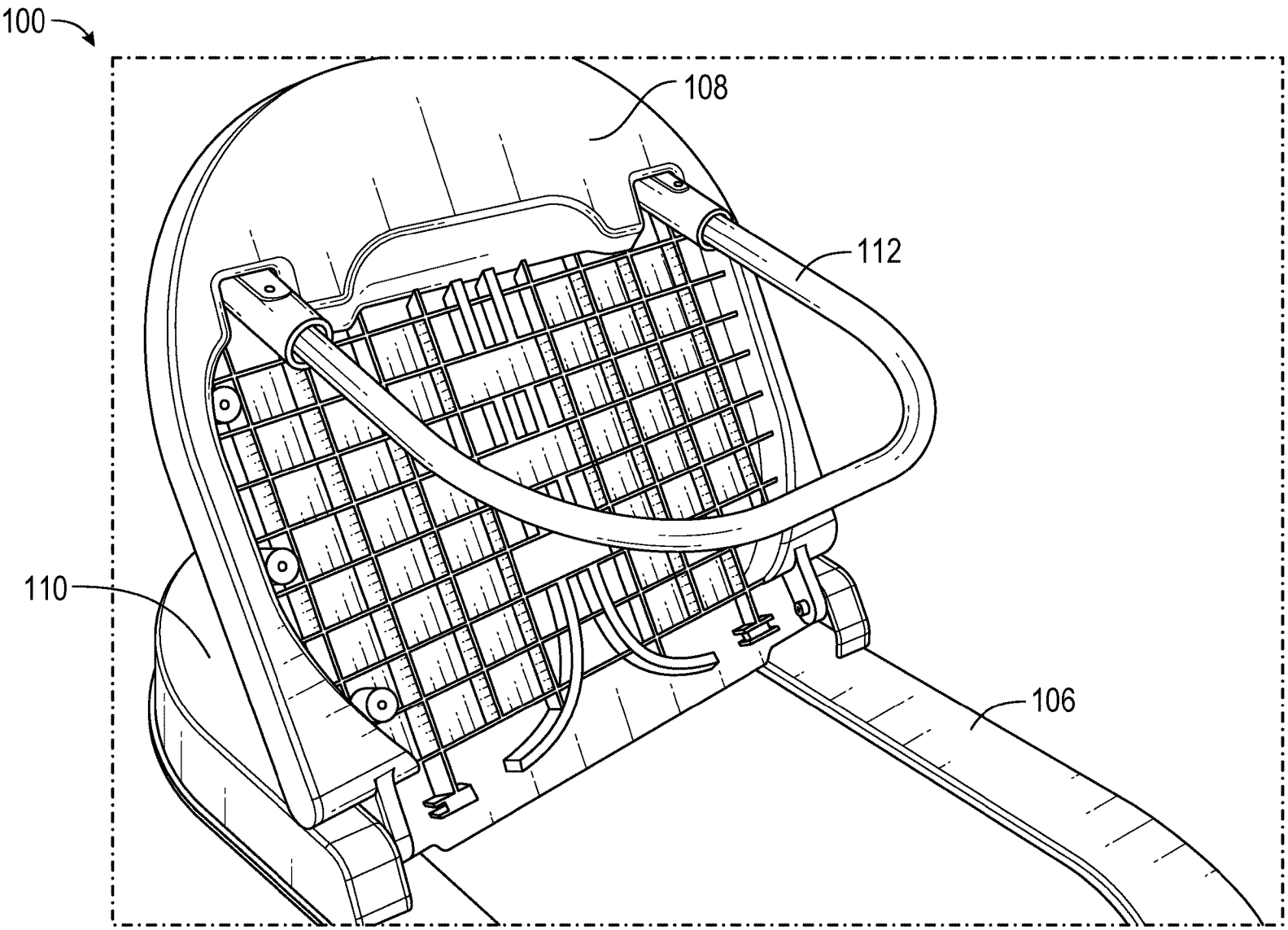
FIG. 3 is a perspective view of the chair component of the convertible children's seat depicted in FIG. 2 in an open configuration in accordance with one example embodiment of the present disclosure.

FIG. 3 depicts a perspective view of the chair component 102 of the convertible children's seat 100 depicted in FIG. 1 in an open configuration. As depicted in FIG. 3, the stationary plate 110 remains mounted to the base 106. In the open configuration, as depicted in FIG. 3, the seat back 108 is rotated about the stationary plate 110 such that the seat back 108 is no longer disposed on the base 106, and the chest bar 112 is further rotated outwards from the seat back 106 such that the chest bar is substantially perpendicular to the seat back 108.

It should be further noted that FIGS. 1A through 3 illustrate a hard goods structure for a convertible children's seat 100, but the convertible children's seat 100 may further include other components, including soft goods for enveloping the hard goods structure. The convertible children's seat 100 may also include additional features to enhance comfort, safety, and other benefits.

FIG. 4 depicts a side view of an example convertible children's seat 400 according to an embodiment of the present disclosure. When the convertible children's seat 400 is in the closed configuration, the convertible children's seat 400 is in "bassinet mode," in which a stationary plate 410 is mounted to and is disposed on the base 406, and the seat back 408 is disposed on the base 406. A parent or other user may attach a mattress 424 to an upper surface of the seat back 408 and an upper surface of the stationary plate 410. The mattress 424 may be mounted on the seat back 408 and the stationary plate 410 by Velcro® or any other suitable manner of connecting the components together.

When the convertible children's seat 400 is in the open configuration, the convertible children's seat 400 is in "floor seat mode," in which the stationary plate 410 remains mounted to and disposed on the base 406, and the seat back 408 is maximally rotated away from the base 406. In the open configuration, the mattress 424 may remain attached to the upper surfaces of the seat back 406 and the stationary plate 410, as the mattress 424 is flexible. As depicted in FIG. 4, the chest bar 422 may be rotated outwards from the seat back 406 to expand a soft goods structure that is configured to form a seat for a child. For example, as depicted in FIG. 4, the soft goods structure may be in the form of a pocket extending downwards from the chest bar 422 for containing a child and having two cutouts in the pocket for the child to extend his or her legs through the pocket.

Figure 5:
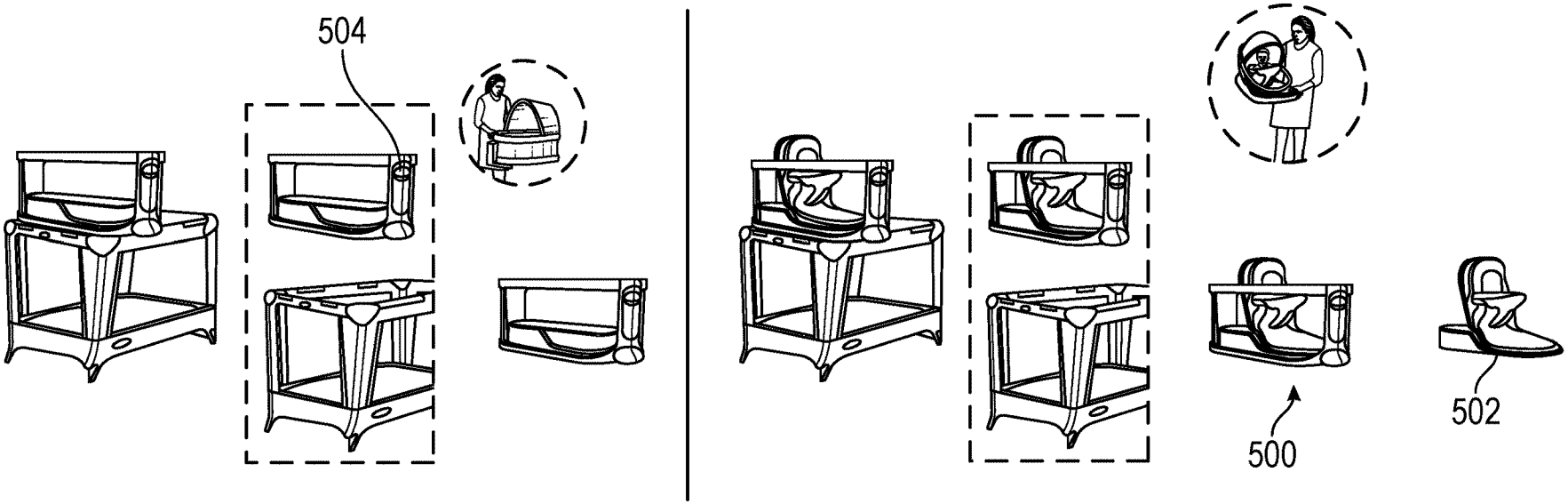
FIG. 5 depicts an example convertible children's seat in various modes in accordance with one example embodiment of the present disclosure.

FIG. 5 depicts an example convertible children's seat 500 in various modes according to an embodiment of the present disclosure. When the chair component 502 is mounted to the enclosure component 504, the enclosure component 504 may be removably mounted to another children's product, such as a playard. If the convertible children's seat 500 is in the closed configuration, the convertible children's seat 500 may be configured to function as a bassinet mounted on a playard. When the chair component 502 is mounted to the enclosure component 504, the enclosure component 504 may additionally be disposed on a flat surface, such as a floor. If the convertible children's seat 500 is in the closed configuration, the convertible children's seat 500 may be configured to function as a bassinet on a floor or other surface. If the convertible children's seat 500 is in the open configuration, the convertible children's seat 500 may be configured to function as a children's seat on a floor or other surface. Further, when the chair component 502 is not mounted to the enclosure component 504, the chair component 502 may function as a standalone children's seat that may be disposed on a floor surface.

In some embodiments, a child may be transported by a parent and/or other user while the child is disposed in the convertible children's seat 500 if the chair component 502 is mounted to the enclosure component 504.

Figure 6:
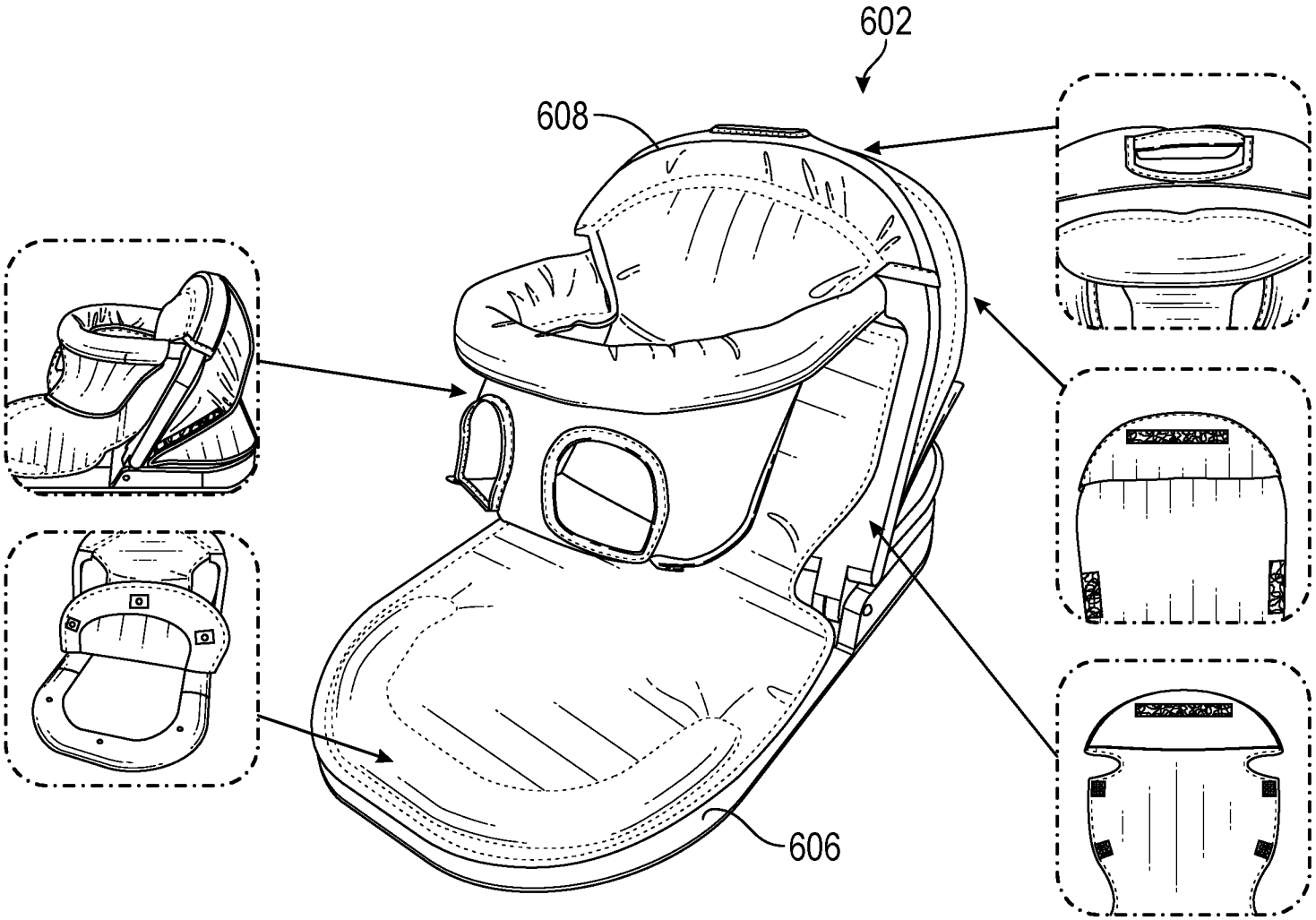
FIG. 6 is a perspective view of an example chair component of a convertible children's seat in accordance with one example embodiment of the present disclosure.

FIG. 6 depicts various features of an example chair component 602 according to an embodiment of the present disclosure. For example, the chair component 602 may include footrest attachments, at least one attachment component for removably connecting the seat back 608 to the base 606, an actuator for the seat back 608, and a back pocket for support.

Figure 7:
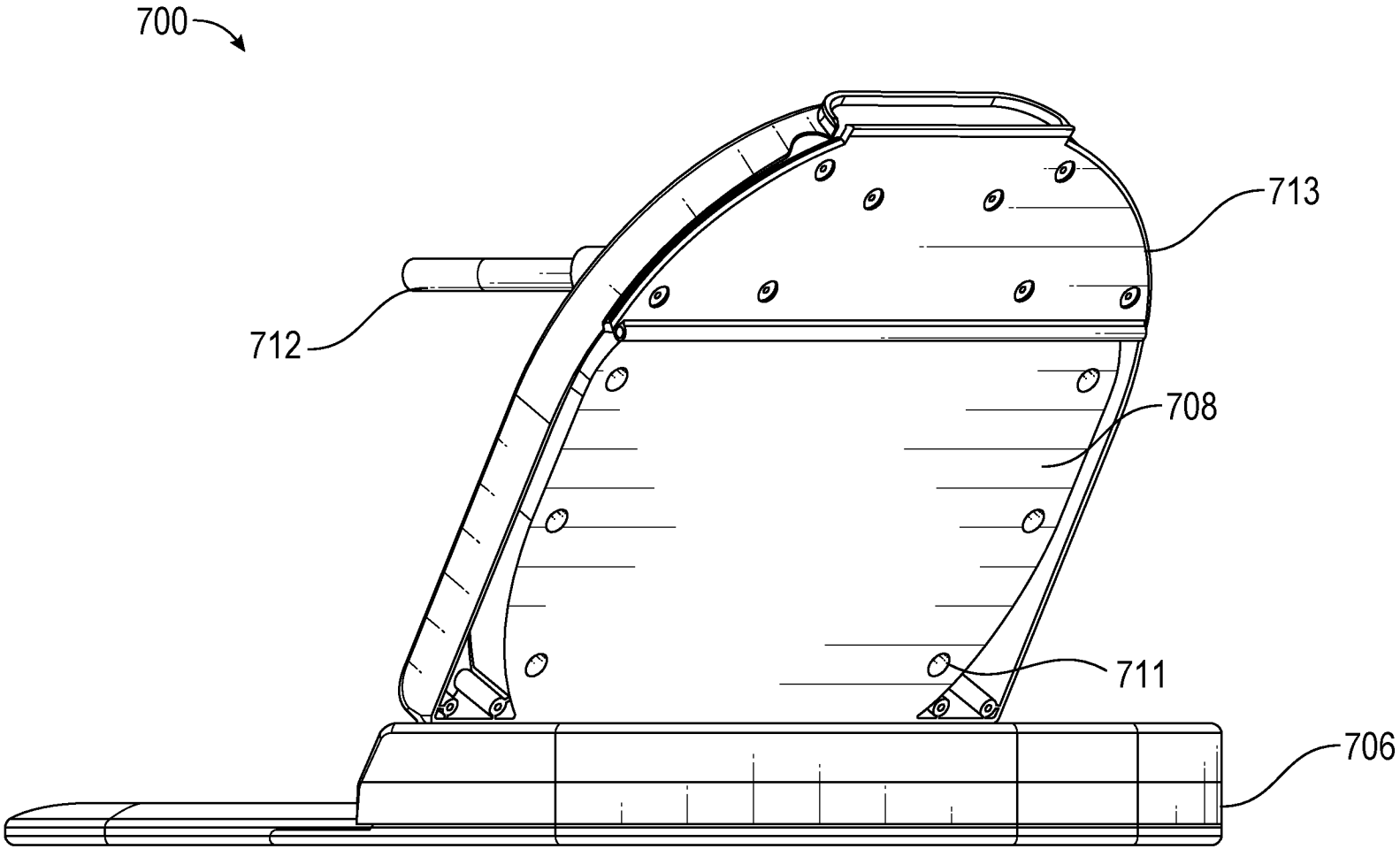
FIG. 7 depicts an example chair component of a convertible children's seat in accordance with one example embodiment of the present disclosure.
Figure 8B:
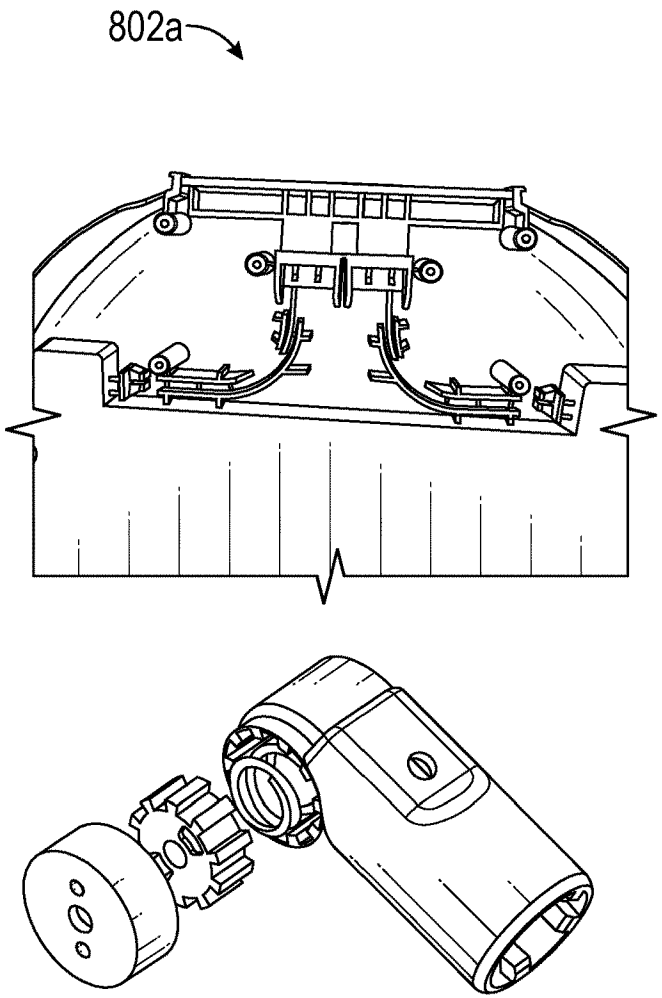
FIG. 8B depicts a second partial view of an example chair component of a convertible children's seat in a released configuration in accordance with one example embodiment of the present disclosure.
Figure 8A:
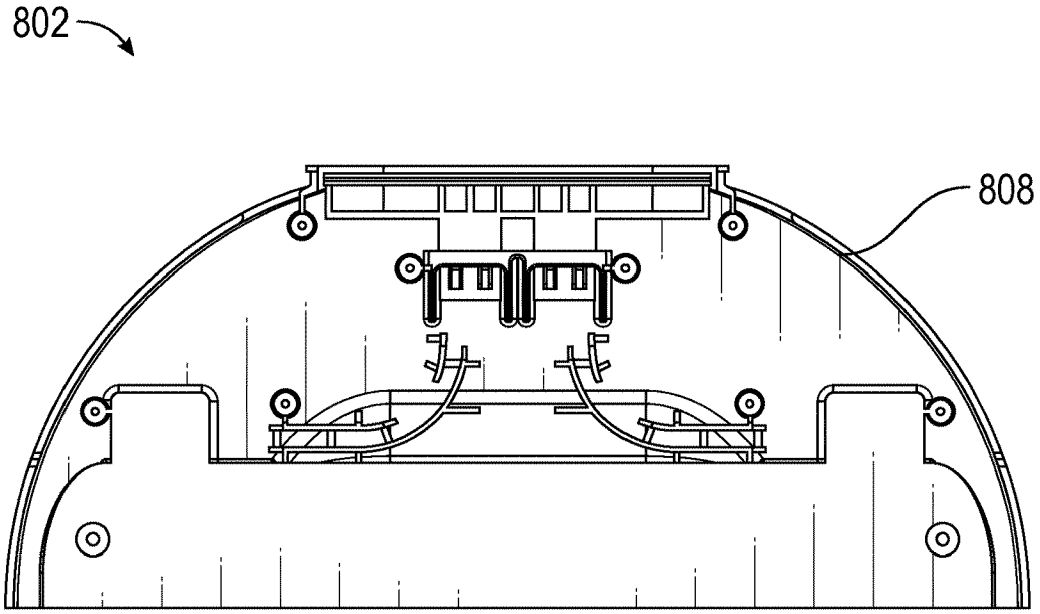
FIG. 8A depicts a first partial view of an example chair component of a convertible children's seat in an attached configuration accordance with one example embodiment of the present disclosure.
Figure 9:
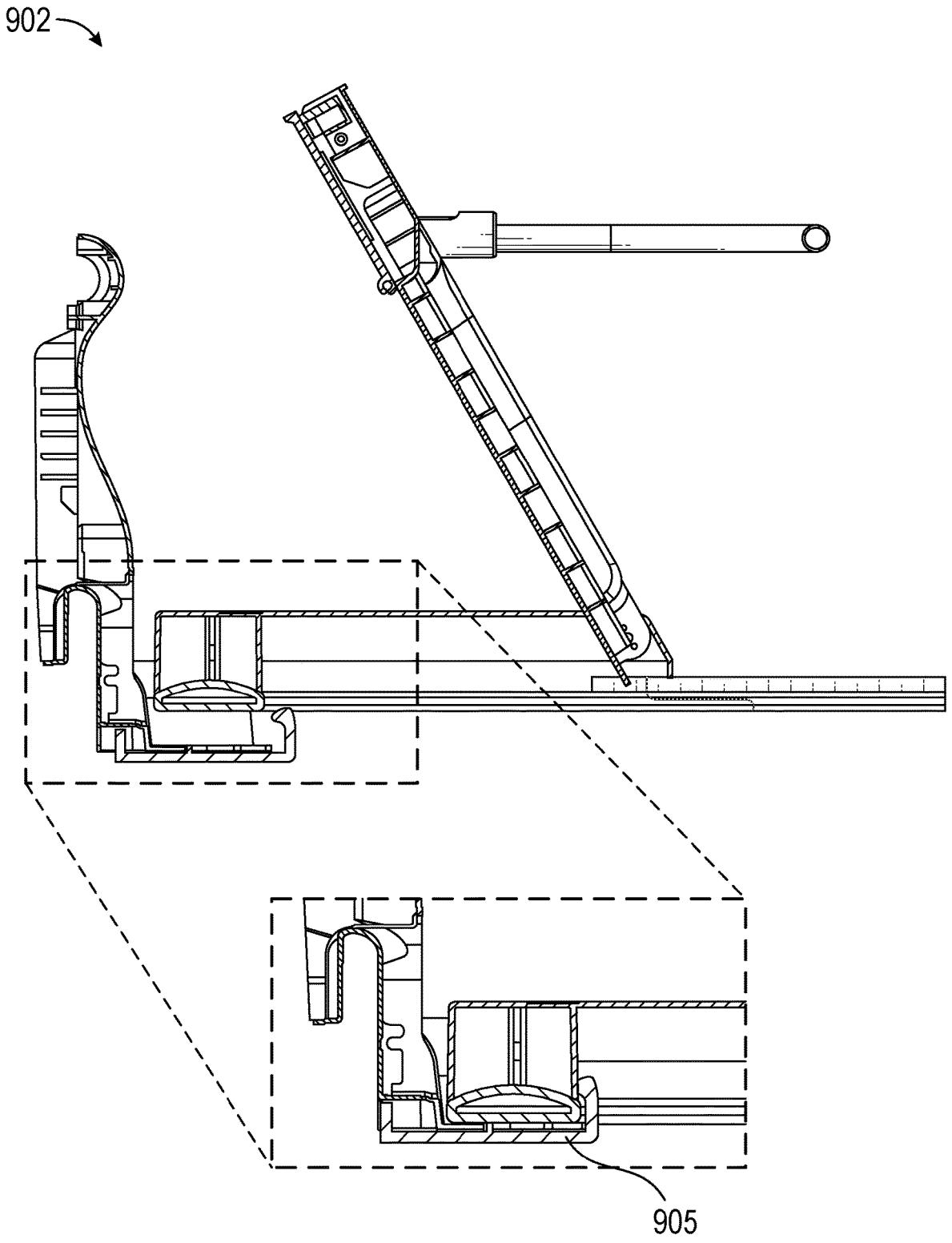
FIG. 9 depicts an example chair component of a convertible children's seat in accordance with one example embodiment of the present disclosure.

FIGS. 7 through 9 depict example chair components of a convertible children's seat according to embodiments of the present disclosure. For example, FIG. 7 illustrates a convertible children's seat 700 including a base 706 and a seat back 708. The seat back 708 may include at least one opening 711 configured for receiving push-through snaps. The seat 700 may include at least one button snap on the base for attaching the seat back 708 to the base.

The seat 700 may include a bezel 713 for aligning soft goods around a seat back actuator. The seat 700 may include a removable torso ring mounted to a chest bar 712. The seat 700 may include a channel along the seat base 706 for a canopy bow.

FIGS. 8A and 8B illustrates an example chair component 802 where a seat back 808 may only be released from a closed configuration 802 (FIG. 8A) to the open configuration 802*a* (FIG. 8B) when a parent and/or other user pushes on two buttons disposed on two different sides of the seat back to release the seat back 808. The benefit of the two-button release mechanism is the reduction of actuation force, the prevention of accidental release by other adults and/or children, and still allows the parent and/or other user to move the convertible children's seat from a closed configuration to an open configuration and vice versa.

FIG. 9 illustrates a chair component 902 including a latching mechanism 905, for use when the enclosure component is a portion of the hard goods structure of a bassinet. When the chair component is removably mounted to the enclosure component (e.g., the bassinet), the latching mechanism 905 may be configured to latch when the enclosure component (e.g., the bassinet) is mounted to the playard. The latching mechanism 905 may then unlatch when the enclosure component (e.g., the bassinet) is not mounted to the playard, thus enabling the chair component to be removed.

Further, although not depicted in FIGS. 1A through 9, it is possible for the mattress or another sleeping surface used in bassinet mode to be modified to form a seating surface for the convertible children's seat when it is in floor seat mode, and it is further possible for a torso ring to be used to create the seating surface.

Though the disclosed examples include particular arrangements of a number of parts, components, features, and aspects, the present disclosure is not limited to only those examples or arrangements shown. Any one or more of the parts, components, features, and aspects of the present disclosure may be employed alone or in other arrangements of any two or more of the same.

Although certain product features, functions, components, and parts have been described herein in accordance with the teachings of the present disclosure, the scope of coverage of this patent is not limited thereto. On the contrary, the present disclosure covers all embodiments of the teachings of the present disclosure that fairly fall within the scope of permissible equivalents.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

Throughout this application, the term "include," "include (s)" or "including" means "including but not limited to." Note that certain embodiments may be described relating to a single component, but the corresponding description should be read to include embodiments of two or more components. Different features, variations, and multiple different embodiments are shown and described herein with various details. What has been described in this application at times in terms of specific embodiments is done for illustrative purposes only and without the intent to limit or suggest that what has been conceived is only one particular embodiment or specific embodiments. It is to be understood that the present disclosure is not limited to any single specific embodiments or enumerated variations. Many modifications, variations and other embodiments will come to mind of those skilled in the art, and which are intended to be and are in fact covered by the present disclosure. It is indeed intended that the scope of the present disclosure should be determined by a proper legal interpretation and construction of the present disclosure, including equivalents, as understood by those of skill in the art relying upon the complete disclosure present at the time of filing.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of systems, methods, apparatuses, devices, and techniques that, individually and in combination, provide for a convertible children's seat. It is, of course, not possible to describe every conceivable combination of components and/or methods for purposes of describing the various elements of the present disclosure, but it can be recognized that many further combinations and permutations of the disclosed elements are possible. Accordingly, it may be apparent that various modifications can be made to the present disclosure without departing from the scope thereof. In addition, or as an alternative, other embodiments of the present disclosure may be apparent from consideration of the specification and annexed drawings, and practice of the present disclosure as presented herein. It is intended that the examples put forth in the specification and annexed drawings be considered, in all respects, as illustrative and not limiting. Although specific terms are employed herein, they are used in a generic and descriptive sense only and not for purposes of limitation.

What is claimed is:

1. A convertible children's seat, comprising:
- a chair component, comprising:
  - a base,
  - a stationary plate mounted to the base, and
  - a seat back mounted to the stationary plate, wherein the seat back is rotatable about the stationary plate;
- an enclosure component, comprising:
  - a first leg comprising a first vertical stand and a first end,
  - a second leg comprising a second vertical stand and a second end, and
  - a wraparound bar mounted to an upper portion of the first leg and an upper portion of the second leg; and
- soft goods wrapped around the chair component and the enclosure component,
- wherein the seat back is configured to rotate between an open configuration and a closed configuration, and
- wherein the chair component is configured to be removably mounted to the enclosure component.

2. The convertible children's seat of claim 1, wherein the base is ring-shaped.

3. The convertible children's seat of claim 1, wherein, when the convertible children's seat is in the closed configuration, the stationary plate and the seat back are disposed on the base.

4. The convertible children's seat of claim 1, wherein the enclosure component is configured to be removably mounted to a children's product.

5. The convertible children's seat of claim 4, wherein the children's product is a playard.

6. The convertible children's seat of claim 1, wherein the enclosure component forms a portion of a hard goods structure of a bassinet.

7. A children's seat apparatus comprising:
a chair component, comprising:
a base,
a stationary plate mounted to the base, and
a seat back rotatably mounted to the stationary plate; and
an enclosure component, wherein the enclosure component is configured to be removably mounted to a children's product,
wherein the seat back is configured to rotate between an open configuration and a closed configuration,
and wherein the chair component is configured to be removably mounted to the enclosure component.

8. The apparatus of claim 7, wherein the enclosure component further comprises:
a first leg comprising a first vertical stand and a first end;
a second leg comprising a second vertical stand and a second end; and
a wraparound bar mounted to an upper portion of the first leg and an upper portion of the second leg.

9. The apparatus of claim 7, further comprising:
soft goods wrapped around the chair component and the enclosure component.

10. The apparatus of claim 7, wherein the base is ring-shaped.

11. The apparatus of claim 7, wherein, when the seat back is in the closed configuration, the stationary plate and the seat back are disposed on the base.

12. The apparatus of claim 7, wherein the children's product is a playard.

13. The apparatus of claim 7, wherein the enclosure component forms a portion of a hard goods structure of a bassinet.

14. A method for implementing a convertible children's seat, comprising:
providing a convertible children's seat, the convertible children's seat comprising:
an enclosure component; and
a chair component configured to be removably mounted to the enclosure component, the chair component comprising:
a base, wherein the base is ring-shaped,
a stationary plate mounted to the base, and
a seat back rotatably mounted to the stationary plate; and
causing the convertible children's seat to be moved between an open configuration and a closed configuration when the seat back is rotated about the stationary plate.

15. The method of claim 14, wherein the enclosure component further comprises:
a first leg comprising a first vertical stand and a first end;
a second leg comprising a second vertical stand and a second end; and
a wraparound bar mounted to an upper portion of the first leg and an upper portion of the second leg.

16. The method of claim 14, wherein the convertible children's seat further comprises soft goods wrapped around the chair component and the enclosure component.

17. The method of claim 14, wherein, when the convertible children's seat is in the closed configuration, the stationary plate and the seat back are disposed on the base.

18. The method of claim 14, further comprising mounting the enclosure component to or removing the enclosure component from a playard.

* * * * *